US006203244B1

(12) United States Patent
Van Ornum

(10) Patent No.: US 6,203,244 B1
(45) Date of Patent: Mar. 20, 2001

(54) SCREEDING APPARATUS

(75) Inventor: Leslie Van Ornum, Hortonville, WI (US)

(73) Assignee: Van-Boh Systems, Inc., Hortonville, WI (US)

( * ) Notice: Subject to any disclaimer, the term of this patent is extended or adjusted under 35 U.S.C. 154(b) by 0 days.

(21) Appl. No.: 09/232,088

(22) Filed: Jan. 15, 1999

Related U.S. Application Data

(60) Provisional application No. 60/071,534, filed on Jan. 15, 1998.

(51) Int. Cl.[7] ..... E01C 19/18

(52) U.S. Cl. ..... 404/110; 404/101; 404/103; 404/118

(58) Field of Search ..... 404/101, 102, 404/103, 108, 110, 118, 122, 124, 128

(56) References Cited

U.S. PATENT DOCUMENTS

| | | | | |
|---|---|---|---|---|
| 1,782,707 | | 11/1930 | Bayley . | |
| 2,146,101 | | 2/1939 | Weber . | |
| 2,306,671 | | 12/1942 | Tamblyn . | |
| 2,346,378 | | 4/1944 | Jackson . | |
| 2,725,799 | * | 12/1955 | Day et al. | 404/102 |
| 2,746,366 | | 5/1956 | Reed . | |
| 3,069,983 | | 12/1962 | Pizzarotti et al. . | |
| 3,156,170 | * | 11/1964 | Behrens et al. | 404/101 |
| 3,221,618 | | 12/1965 | Hudis . | |
| 3,247,770 | | 4/1966 | Perkins et al. . | |
| 3,309,971 | | 3/1967 | Domenighetti . | |
| 3,412,658 | | 11/1968 | Griffin . | |
| 3,450,011 | | 6/1969 | Godbersen . | |
| 3,494,426 | | 2/1970 | Studebaker . | |
| 3,526,173 | | 9/1970 | Brandstetter | 94/44 |
| 3,541,931 | | 11/1970 | Godbersen . | |
| 3,541,932 | | 11/1970 | Hodson . | |
| 3,543,939 | | 12/1970 | Dupler . | |
| 3,550,511 | | 12/1970 | Potts . | |
| 3,588,249 | | 6/1971 | Studebaker . | |
| 3,588,349 | | 6/1971 | Kawal . | |
| 3,602,112 | | 8/1971 | Burks . | |
| 3,602,115 | | 8/1971 | Hanson . | |
| 3,604,512 | | 9/1971 | Carter . | |
| 3,636,832 | | 1/1972 | Schrimper et al. . | |
| 3,638,540 | | 2/1972 | Williams . | |
| 3,779,661 | | 12/1973 | Godbersen . | |
| 3,779,662 | | 12/1973 | Smith . | |
| 3,816,014 | | 6/1974 | Klopf . | |
| 3,841,777 | | 10/1974 | Domenighetti . | |
| 3,873,226 | | 3/1975 | Teach . | |
| 3,887,012 | | 6/1975 | Scholl et al. . | |
| 3,907,451 | | 9/1975 | Fisher et al. . | |
| 3,953,145 | | 4/1976 | Teach . | |
| 3,959,977 | | 6/1976 | Godbersen . | |
| 4,073,592 | | 2/1978 | Godberson et al. . | |
| 4,162,708 | | 7/1979 | Johnson . | |
| 4,236,587 | * | 12/1980 | Shader et al. | 172/779 |
| 4,266,917 | | 5/1981 | Godbersen . | |

(List continued on next page.)

* cited by examiner

*Primary Examiner*—Thomas B. Will
*Assistant Examiner*—Kristine M. Markovich
(74) *Attorney, Agent, or Firm*—Godfrey & Kahn, SC; William K. Baxter

(57) ABSTRACT

A screeding attachment for an industrial utility vehicle. The screed and vehicle in combination provide a low cost, maneuverable and versatile screeding unit for screeding small and medium size pavements such as driveways, sidewalks, slabs and surfaces inside buildings and the like. A see-through frame supported on castered wheels and a see-through distribution and deposition system for metering and depositing paving materials in the path of a grooved cylindrical screed provide an apparatus for continuously laying a screeded slab under the direct observation of an operator in the industrial utility vehicle.

5 Claims, 3 Drawing Sheets

U.S. PATENT DOCUMENTS

| | | | | |
|---|---|---|---|---|
| 4,273,196 | | 6/1981 | Etsusake et al. . | |
| 4,329,081 | * | 5/1982 | Buvik | 404/110 |
| 4,340,351 | | 7/1982 | Owens . | |
| 4,349,294 | | 9/1982 | Allen . | |
| 4,371,287 | | 2/1983 | Johansson . | |
| 4,466,757 | | 8/1984 | Allen . | |
| 4,470,783 | | 9/1984 | Friebel et al. . | |
| 4,484,834 | | 11/1984 | Rowe et al. . | |
| 4,655,633 | | 4/1987 | Somero et al. . | |
| 4,708,519 | * | 11/1987 | Davin et al. | 404/108 |
| 4,871,025 | * | 10/1989 | Mayfield et al. | 404/101 |
| 4,888,890 | | 12/1989 | Studebaker et al. . | |
| 4,895,476 | * | 1/1990 | Vangaever | 404/108 |
| 4,930,935 | | 6/1990 | Quenzi et al. | 404/75 |
| 4,978,246 | | 12/1990 | Quenzi et al. . | |
| 5,046,888 | * | 9/1991 | King | 404/108 |
| 5,234,281 | | 8/1993 | Somero et al. . | |
| 5,348,418 | * | 9/1994 | Campbell | 404/122 |
| 5,470,175 | * | 11/1995 | Jensen et al. | 404/108 |
| 5,529,131 | | 6/1996 | Van Ornum | 172/789 |

SCREEDING APPARATUS

CROSS REFERENCE TO RELATED APPLICATIONS

This application claims the benefit of U.S. Provisional Application Ser. No. 60/071,534, filed Jan. 15, 1998.

BACKGROUND OF THE INVENTION

This invention relates to a screeding attachment that is securable to the bucket tilt mechanisms of an industrial utility vehicle to provide a low cost highly maneuverable and versatile self propelled screeding apparatus. More specifically this invention relates to an attachment which detachably secures a special function apparatus to an industrial utility vehicle to provide a low cost self propelled special function piece of equipment while not requiring the dedication of the industrial utility vehicle to that special function. The special function of the attachment of this invention is the screeding of flowable paving materials.

The use of a simple beam as a screed to level paving materials has been practiced since the dawn of paving technology.

Self propelled screeds are known in the art. Brandstetter, U.S. Pat. No. 3,526,173, is one such self propelled screeding apparatus.

The employment of special function attachments which are secured to the bucket tilt mechanisms of industrial utility vehicles is also known in the art. The instant inventor's U.S. Pat. No. 5,529,131 is for one such an attachment.

There has been a long felt and unfulfilled need in the art for a low cost, maneuverable, self propelled screeding apparatus for pouring small and moderate size pavement jobs such as driveways, sidewalks and slabs inside structures.

There has been a long felt and unfulfilled need in the art for a self propelled screeding apparatus as described above that is adaptable to a wide range of screeding mechanisms, controls, guides and aids.

There has been a long felt and unfulfilled need in the art for a means for distributing and depositing paving materials in the amount desired and at the location desired so as to minimize the amount of paving material to be moved in order to strike off and true the surface being poured.

This invention relates to solutions to the problems raised above and to improvements to existing solutions to those problems.

SUMMARY OF THE INVENTION

The invention in its simplest form is a screeding attachment for an industrial utility vehicle. The attachment includes a substantially rectangular frame having a longitudinal axis along the direction in which screeding will be performed, a vehicle end member, and a screed end member positioned transverse to the longitudinal axis. The frame further includes a first frame side member and a second frame side member positioned parallel to the longitudinal axis, one to each side of the frame. The vehicle end frame member has as a part thereof a coupling means which is engageable with and disengageable from a bucket tilt mechanism of an industrial utility vehicle. The vehicle end frame member is positioned so as to permit the operator of a utility vehicle to which the screeding attachment is attached to observe the functioning of a screed attached to the screed side member. The first side member and the second side member each have depending therefrom a ground engaging castered wheel assembly.

In general terms, the invention involves the provision of a novel means for distributing and depositing paving materials uniformly and continuously in front of the screed while preserving an operator's view of the screed, and a novel screed that exploits the uniform deposition of paving material and the operator's view of the screed to achieve a superior screeding of the paving materials.

Other objects and utilities provided by this invention will be made apparent from the following specification, drawings, and claims.

DESCRIPTION OF THE PREFERRED EMBODIMENTS

Figure 1:
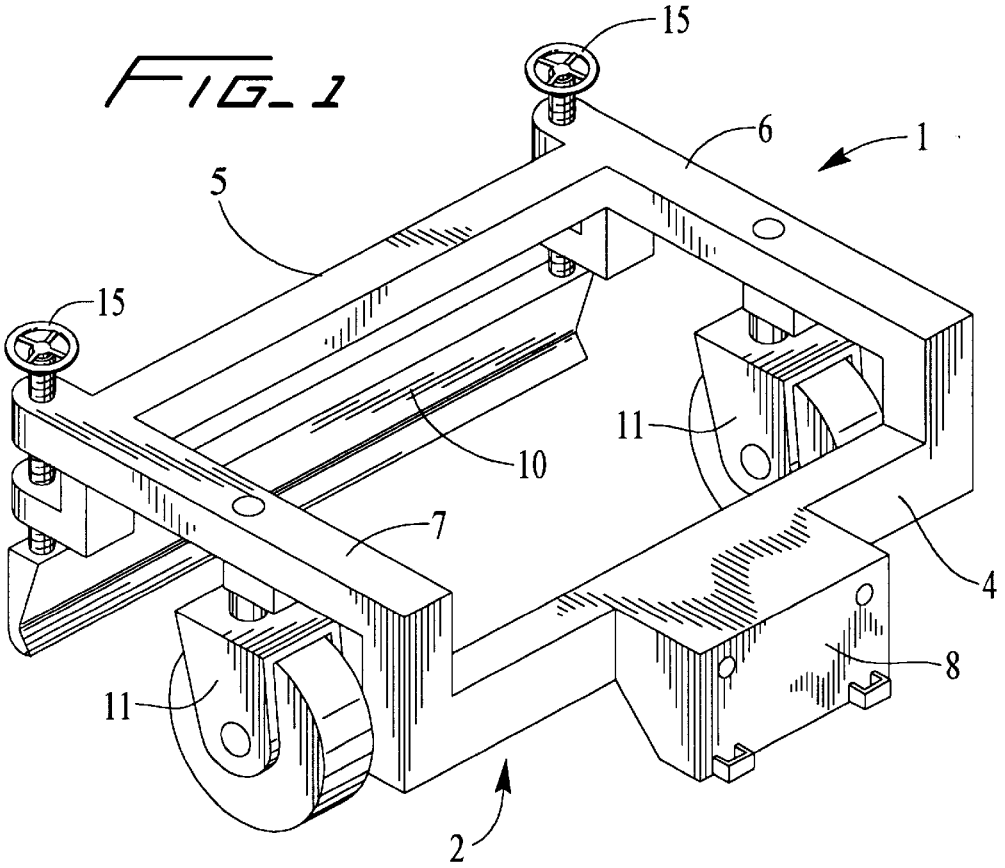
FIG. 1 is an isometric view of a screeding apparatus constructed according to a preferred embodiment of this invention.

In the drawing figures, like numbers refer to like members. The proportions of some elements have been modified to facilitate illustration.

Figure 2:
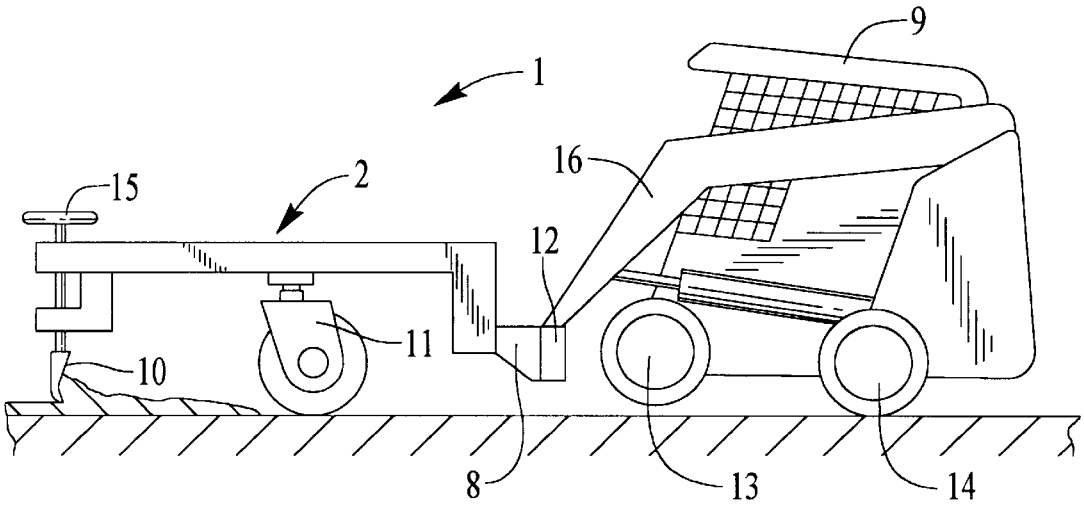
FIG. 2 is a side elevational view of the screeding apparatus shown in FIG. 1, shown attached to an industrial utility vehicle.
Figure 3:
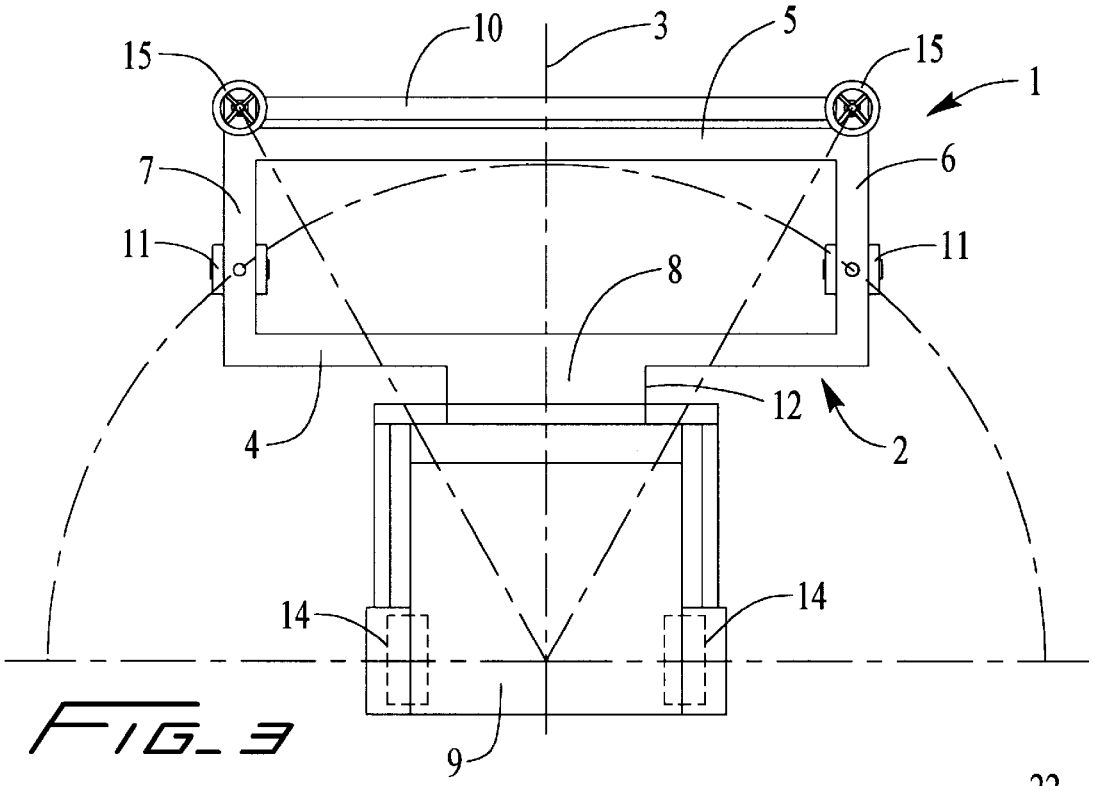
FIG. 3 is a top plan view of the screeding apparatus and utility vehicle shown in FIG. 2.

Referring now to FIGS. 1 through 3, the screeding apparatus 1 of this invention is shown in simplified form. According to the present invention, the screeding apparatus 1 includes a substantially rectangular frame 2 having a longitudinal axis 3 lying in the direction in which screeding will occur. A vehicle end member 4 and a screed end member 5 are positioned transverse to axis 3. A first side frame member 6 and a second side frame member 7 are positioned parallel to axis 3. The frame 2 is connected to a utility vehicle 9 by means of a coupling member or means 8, which is incorporated with vehicle end member 4. The frame 2 constructed and positioned so as to permit the operator of utility vehicle 9 to observe the operation of a screed 10, attached to the screed end member 5. A first side member 6 and second side member 7, connected together by vehicle end member 4 and screed end member 5, have depending therefrom ground engaging castered wheel assemblies 11.

In the most preferred embodiment, the utility vehicle 9 is a skid steer loader, with front wheels 13 and rear wheels 14. The screeding apparatus 1 of the present invention is mounted to conventional bucket arms 16 by a bucket tilt mechanism 12, in the place where the bucket (not shown) of the skid steer loader is normally mounted. The arms 16 conventionally have the ability to be raised and lowered, and in fact they can be lowered enough that the front wheels 13 are lifted off the ground or other support surface on which the vehicle 9 is resting. When the screeding apparatus 1 is connected to vehicle 9, and the arms 16 are lowered to that extent, so as to raise front wheels 13 of the vehicle off of the ground, the combination of screeding apparatus 1 and vehicle 9 can pivot about rear wheels 14 on castered wheels 11 as illustrated schematically in FIGS. 2 and 3. This provides a highly maneuverable self propelled screeding apparatus.

When the front wheels 13 of vehicle 9 are raised off of the ground, the screeding apparatus 1 is supported, as indicated above, by the widely spaced castered wheels 11 and the closely spaced rear wheels 14 of vehicle 9, a three point support for the moving screeding apparatus is formed, establishing a plane to which screed 10 may be adjusted by means of adjustments 15 to provide a screeded pavement of a uniform thickness on top of the plane over which the screeding apparatus moves.

Adjustments 15 are shown schematically as hand wheels and screeding apparatus 1 is guided by its underlying plane. The art of screeding abounds in a very great number and many kinds of controls, guides, and adjustments to which the screed apparatus of this invention can be adapted. The underlying invention is sufficiently accommodating to adapt to most of the forms of guiding adjusting and control that are known in the art, including laser, hydraulic and pneumatic controls, without departing from the scope of the invention.

Figure 4:
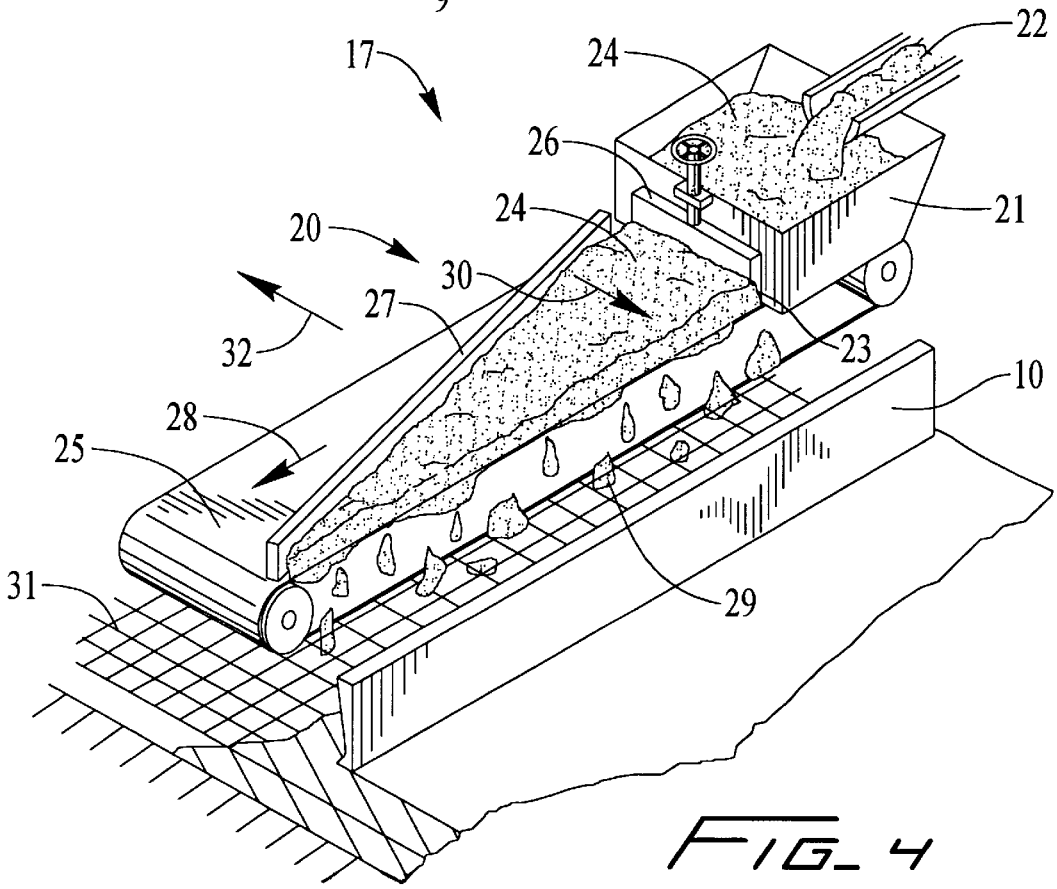
FIG. 4 is an isometric view of the screed shown in FIGS. 1 through 3, showing paving materials being distributed and deposited in the vicinity of the screed.

Another embodiment of the invention is shown in FIG. 4. As there shown, screeding apparatus 17 is shown to be screeding paving material 24 distributed and deposited by paving material distribution and deposition means 20 into the path of screed 10. Distribution and deposition means 20 is designed to be supported on frame 2 of FIGS. 1–3 and includes a hopper 21 and a paving materials supplier 22. Hopper 21 is provided with a bottom opening 23 through which paving material 24 is discharged. A belt conveyor 25 passes under bottom opening 23, and an adjustable gate 26 serves to meter paving material 24 onto conveyor 25. A deflector beam 27 is positioned diagonally over conveyor 25 for the purpose of deflecting paving material 24 off conveyor 25 uniformly along a length of conveyor 25.

In use, conveyor 25 is positioned transverse to longitudinal axis 3 of frame 2 and above the line of sight between an operator of utility vehicle 9 and screed 10. Gate 26 is vertically adjusted, according to the speed of conveyor 25 in the direction of arrow 28, so that deflector beam 27 urges paving material 24 off the side of conveyor 25 in the direction of arrow 30, at a rate such that paving material 24 forms globules 29, thereby creating a shower of globules 29 through which the screeding action of screed 10 is observable by an operator of vehicle 9.

In the laying of paved slabs, it is often desirable to reinforce the slab by incorporating into its structure a mesh or screen such as mesh 31 of FIG. 4. Heretofore, when paving materials have been dumped or poured into the area to be paved, the pressure and weight of the dump has caused the mesh to be pressed downward and unless steps were taken to reposition the mesh it frequently was located at or near the bottom of the finished slab. By depositing paving material 24 in the form of globules 29 from a height above the surface to be paved, the kinetic energy and hydraulics of falling globules 29 causes paving material 24 to pass through mesh 31 and flow under mesh 31 before paving material 24 builds up over mesh 31 as screed 10 advances in the direction of arrow 32. The kinetic energy of the falling globules 29 causes the aggregate in the concrete to be urged downward into the slab and the more flowable materials are urged upward, thereby consolidating the aggregate and providing a top surface that is more flowable and more readily screeded and trued. The uniform distribution and deposition of paving material achieved by distribution and deposition means 20 provides a uniform deposition so that less excess paving material 24 needs to be advanced by screed 10 in order to ensure that sufficient surplus material 24 is being advanced to fill depressions as screeding progresses in the direction of arrow 32.

The uniformity of deposition achieved by distribution and deposition means 20 permits the use of a novel grooved cylindrical screed to achieve a true and uniform screeded surface.

Figure 5:
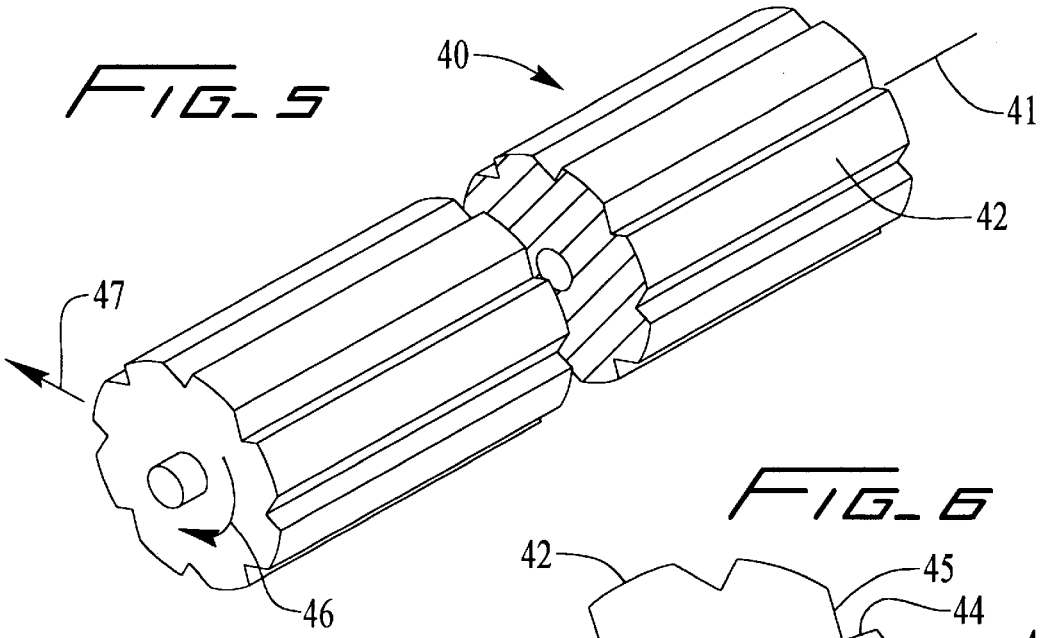
FIG. 5 is an isometric view of a grooved cylindrical screed employed in a preferred embodiment of the present invention.
Figure 6:
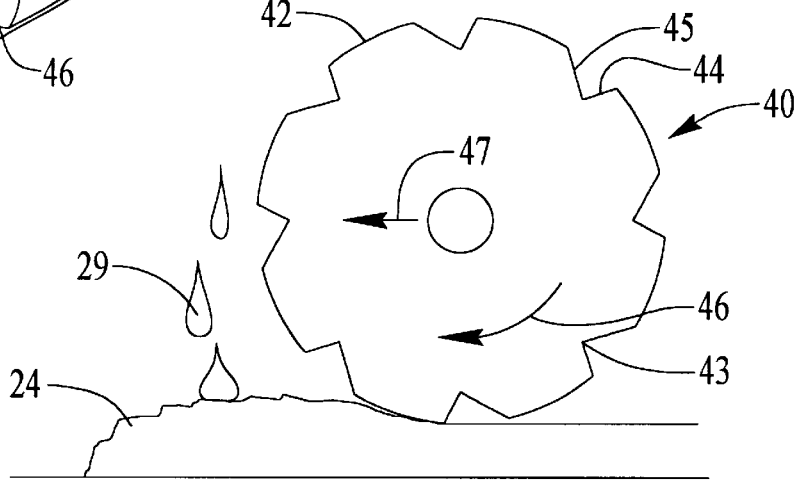
FIG. 6 is a side elevational view of the screed shown in FIG. 5.
Figure 7:
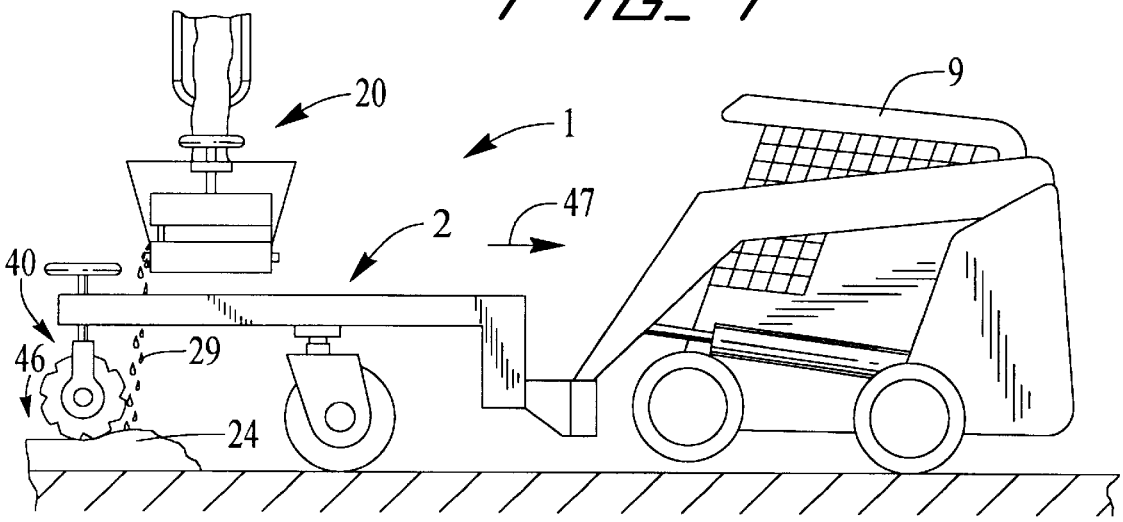
FIG. 7 is a side elevational view of the screed attachment of the present invention, having a distribution and deposition means and a cylindrical screed.

Yet another embodiment is shown in FIGS. 5–7, wherein a grooved cylindrical screed 40 is illustrated. Cylindrical screed 40 has a rotational axis 41 and a cylindrical surface 42. Formed in the surface 42 are multiple longitudinal v-shaped grooves 43. In the most preferred embodiment, grooves 43 have a short side 44 and a long side 45 (FIG. 6).

Screed 40 is positioned transverse to longitudinal axis 3 and depends adjustably from frame 2 as shown in FIG. 7. Screed 40 rotates in a direction according to arrow 46, while at the same time being moved linearly along a translational direction according to arrow 47, such that surface 40 is rotating in the translational direction 47 when surface 40 is in contact with paving material 24.

Because distribution and deposition means 20 provides a uniform deposition of paving material 24 in the vicinity of cylindrical screed 40, there is not a need to maintain any substantial surplus of paving material 24 in front of screed 40. Further, screed 40 serves to consolidate the aggregate in paving material 24 and to spread the flowable material of paving material 24 uniformly over the screeded surface by way of v-shaped grooves 43 and to calender or smoothe the screeded surface. The resulting screeded surface is a flat, true and smooth surface of general utility quality.

The apparatus shown in FIG. 7 represents schematically the best mode of practicing the invention known to the inventor at the time of filing of this patent application. As shown there, screeding apparatus 1 has frame 2 shown to have adjustably depending therefrom grooved cylindrical screed 40. Frame 2 is shown to have supported thereon distribution and deposition means 20. Apparatus 1 is engaged with industrial vehicle 9.

It should be understood that the embodiments of the invention disclosed above are enabling so that one skilled in the art can make and use the disclosed invention without undue experimentation. However, the invention admits within its scope numerous variations and a large variety of guides, adjustments and controls can be employed in practicing the invention without departing from the scope of the invention. To disclose the variations and additions that are within the scope of the invention would greatly multiply the drawings and claims and cause the specification to become prolix. Therefore, the scope of this invention should not be limited to the embodiments disclosed herein. Rather, the scope of the invention should only be limited by the scope of the appended claims and all equivalents thereto that would be made apparent to one skilled in the art. The disclosures of the cited references throughout the application are hereby incorporated by reference herein.

What is claimed is:

1. A screeding attachment for an industrial utility vehicle comprising:

a) a substantially rectangular frame having a longitudinal axis, a vehicle end member and a screed end member positioned transverse to the axis, a first side frame member and a second side frame member positioned parallel to said axis with one side frame member on each side of the axis, the first and second side frame members connecting to the vehicle end member and the screed end member, the screed end member positioned rearwardly from the vehicle end member;

b) a coupling means secured to the frame on the vehicle end member, said coupling means being engageable with and disengageable from a bucket tilt mechanism on the industrial utility vehicle;

c) two castered ground engaging wheel assemblies, one wheel assembly depending from the first side frame member, the other wheel assembly depending from the second side frame member, the wheel assemblies being widely spaced apart at positions on each side of the longitudinal axis;

d) a screed moveably secured to the screed end member and positioned transverse to the longitudinal axis;

e) wherein the frame is configured so as to provide an unobstructed view of the screed from the industrial utility vehicle with which the screeding attachment is engaged; and f) a paving material distribution and deposition means supportable by the frame of the screeding attachment, the paving material distribution and deposition means comprising:

i) a hopper for receiving paving material from a supply of paving material, the hopper having a bottom opening for discharging paving material;

ii) a belt conveyor passing under the bottom opening and positioned over the frame;

iii) an adjustable gate secured to said hopper and positioned so as to regulate and meter the flow of paving material from the hopper onto the conveyor; and iv) a deflector beam positioned diagonally over said conveyor for the purpose of deflecting paving material off of the conveyor uniformly along the length of the conveyor.

2. A screeding attachment for an industrial utility vehicle comprising:

a) a substantially rectangular frame having a longitudinal axis, a vehicle end member and a screed end member positioned transverse to the axis, a first side frame member and a second side frame member positioned parallel to said axis with one side frame member on each side of the axis, the first and second side frame members connecting to the vehicle end member and the screed end member, the screed end member positioned rearwardly from the vehicle end member;

b) a coupling means secured to the frame on the vehicle end member, said coupling means being engageable with and disengageable from a bucket tilt mechanism of the industrial utility vehicle;

c) two castered ground engaging wheel assemblies, one wheel assembly depending from the first side frame member, the other wheel assembly depending from the second side frame member, the wheel assemblies being widely spaced apart at positions on each side of the longitudinal axis;

d) a screed moveably secured to the screed end member and positioned transverse to the longitudinal axis;

e) wherein the frame is configured so as to provide an unobstructed view of the screed from the industrial utility vehicle with which the screeding attachment is engaged;

f) a paving material distribution and deposition means supportable by the frame of the screeding attachment, the paving material distribution and deposition means comprising:

i) a hopper for receiving paving material from a supply of paving material, the hopper having a bottom opening for discharging paving material;

ii) a belt conveyor passing under the bottom opening and positioned over the frame;

iii) an adjustable gate secured to said hopper and positioned so as to regulate and meter the flow of paving material from the hopper onto the conveyor; and iv) a deflector beam positioned diagonally over said conveyor for the purpose of deflecting paving material off of the conveyor uniformly along the length of the conveyor; and g) wherein the conveyor is positioned transverse to the longitudinal axis of the frame and above a line of sight from the utility vehicle to the screed, and the speed of the conveyor and the flow of the paving material onto the conveyor is adjustable so that the paving material is deflected off of the conveyor in globules and clumps.

3. A screeding attachment for an industrial utility vehicle comprising:

a) a substantially rectangular frame having a longitudinal axis, a vehicle end member and a screed end member positioned transverse to the axis, a first side frame member and a second side frame member positioned parallel to said axis with one side frame member on each side of the axis, the first and second side frame members connecting to the vehicle end member and the screed end member, the screed end member positioned rearwardly from the vehicle end member;

b) a coupling means secured to the frame on the vehicle end member, said coupling means being engageable with and disengageable from a bucket tilt mechanism of the industrial utility vehicle;

c) two castered ground engaging wheel assemblies, one wheel assembly depending from the first side frame member, the other wheel assembly depending from the second side frame member, the wheel assemblies being widely spaced apart at positions on each side of the longitudinal axis;

d) a cylindrical screed having a cylindrical surface and longitudinal v-shaped grooves formed in the cylindrical surface, the cylindrical screed adjustably secured to the screed end member and positioned transverse to the longitudinal axis;

e) a paving material distribution and deposition means supported by the frame of the screeding attachment the paving material distribution and deposition means comprising:

i) a hopper for receiving paving material from a supply of paving material, the hopper having a bottom opening for discharging paving material;

ii) a belt conveyor passing under the bottom opening and positioned over the frame;

iii) an adjustable gate secured to said hopper and positioned so as to regulate and meter the flow of paving material from the hopper onto the conveyor; and iv) a deflector beam positioned diagonally over said conveyor for the purpose of deflecting paving material off of the conveyor uniformly along the length of the conveyor; and f) wherein the frame is configured so as to provide an unobstructed view of the screed from the industrial utility vehicle with which the screeding attachment is engaged.

4. A screeding apparatus comprising:

a) an industrial utility vehicle having front wheels, rear wheels, bucket arms and a bucket tilt mechanism attached to the bucket arms where a bucket is normally mounted;

b) a screeding attachment having a substantially rectangular frame with a longitudinal axis, a vehicle end member and a screed end member positioned transverse to the axis a first side frame member and a second side frame member positioned parallel to said axis with one side frame member on each side of the axis, the first and second side frame members connecting to the vehicle end member and the screed end member, the screed end member positioned rearwardly from the vehicle end member;

c) a coupling means secured to the frame on the vehicle end member, said coupling means being engagable with and disengagable from the bucket tilt mechanism on the industrial utility vehicle;

d) two castered ground engaging wheel assemblies, one wheel assembly depending from the first side frame member, the other wheel assembly depending from the second side frame member, the wheel assemblies being widely spaced apart at positions on each side of the longitudinal axis;

e) a screed moveably secured to the screed end member and positioned transverse to the longitudinal axis; and f) a paving material distribution and deposition means supportable by the frame of the screeding attachment, the paving material distribution and deposition means comprising:

i) a hopper for receiving paving material from a supply of paving material, the hopper having a bottom opening for discharging paving material;

ii) a belt conveyor passing under the bottom opening and positioned over the frame;

iii) an adjustable gate secured to said hopper and positioned so as to regulate and meter the flow of paving material from the hopper onto the conveyor; and iv) a deflector beam positioned diagonally over said conveyor for the purpose of deflecting paving material off of the conveyor uniformly along the length of the conveyor.

5. A screeding apparatus comprising:

a) an industrial utility vehicle having front wheels, rear wheels, bucket arms and a bucket tilt mechanism attached to the bucket arms where a bucket is normally mounted;

b) a screeding attachment having a substantially rectangular frame with a longitudinal axis, a vehicle end member and a screed end member positioned transverse to the axis, a first side frame member and a second side frame member positioned parallel to said axis with one side frame member on each side of the axis, the first and second side frame members connecting to the vehicle end member and the screed end member, the screed end member positioned rearwardly from the vehicle end member;

c) a coupling means secured to the frame on the vehicle end member, said coupling means being engagable with and disengagable from the bucket tilt mechanism on the industrial utility vehicle;

d) two castered ground engaging wheel assemblies, one wheel assembly depending from the first side frame member, the other wheel assembly depending from the second side frame member, the wheel assemblies being widely spaced apart at positions on each side of the longitudinal axis;

e) a screed moveably secured to the screed end member and positioned transverse to the longitudinal axis;

f) a paving material distribution and deposition means supportable by the frame of the screeding attachment, the paving material distribution and deposition means comprising:

i) a hopper for receiving paving material from a supply of paving material, the hopper having a bottom opening for discharging paving material;

ii) a belt conveyor passing under the bottom opening and positioned over the frame;

iii) an adjustable gate secured to said hopper and positioned so as to regulate and meter the flow of paving material from the hopper onto the conveyor; and iv) a deflector beam positioned diagonally over said conveyor for the purpose of deflecting paving material off of the conveyor uniformly along the length of the conveyor; and g) wherein the conveyor is positioned transverse to the longitudinal axis of the frame and above a line of sight from the utility vehicle to the screed, and the speed of the conveyor and the flow of the paving material onto the conveyor is adjustable so that the paving material is deflected off of the conveyor in globules and clumps.

* * * * *